US005314190A

United States Patent [19]

Lyons

[11] Patent Number: 5,314,190

[45] Date of Patent: May 24, 1994

[54] MATHEMATICAL GAME

[76] Inventor: Malcolm J. Lyons, 120 Bishopsgate Street, Carlisle, Western Australia 6101, Australia

[21] Appl. No.: 930,085

[22] Filed: Aug. 14, 1992

[30] Foreign Application Priority Data

Aug. 16, 1991 [AU] Australia ..... PK7784

[51] Int. Cl.[5] ..... A63F 3/00

[52] U.S. Cl. ..... 273/272; 434/191

[58] Field of Search ..... 273/272, 299; 434/191, 434/208

[56] References Cited

U.S. PATENT DOCUMENTS

| | | | |
|---|---|---|---|
| 2,198,670 | 4/1940 | Johnson | 273/299 |
| 3,844,568 | 10/1974 | Armstrong | 273/272 |
| 3,904,207 | 9/1975 | Gold | 273/272 |
| 4,017,080 | 4/1977 | Severson | 273/272 |
| 4,306,612 | 2/1982 | Harder | 273/272 |
| 4,565,374 | 1/1986 | Pak | 273/272 |

FOREIGN PATENT DOCUMENTS

| | | |
|---|---|---|
| 1054790 | 8/1977 | Canada . |
| 2054894 | 5/1971 | France . |
| 2302118 | 9/1976 | France . |
| 618631 | 2/1949 | United Kingdom . |
| 1304882 | 1/1973 | United Kingdom . |
| 1396267 | 6/1975 | United Kingdom . |
| 2018606 | 10/1979 | United Kingdom . |
| 2121692 | 1/1984 | United Kingdom . |

*Primary Examiner*—William H. Grieb
*Attorney, Agent, or Firm*—Ladas & Parry

[57] ABSTRACT

A mathematical game comprising a plurality of elongate tiles adapted to be laterally or longitudinally located on a playing surface. The elongate tiles comprising a set of numerical tiles bearing a numerical symbol and a set of operational tiles bearing a mathematical operation symbol and a numerical symbol. On the operational tiles the numerical symbol is located to the right side of the tile and the mathematical operation symbol is located to the left side of the tile. Three tiles consisting of two numerical tiles and one operational tile are linearly arrangeable on the playing surface to form a mathematical equation such that the operational tile is locatable between the two numerical tiles. The operational tile reflects the mathematical relationship between the numerical tiles. The operational tiles are provided with a visual distinguishing characteristic so that when the tiles are arranged in an equation the operational tile distinguishes one side of the equation from the other.

10 Claims, 2 Drawing Sheets

MATHEMATICAL GAME

TECHNICAL FIELD

The present invention relates to a mathematical game and game pieces. More particularly, the game relates to the making of mathematical equations either on a board provided or on any surface utilising the game pieces.

BACKGROUND OF THE INVENTION

A number of mathematical games for the making of equations have been known. One of the more popular mathematical games has been the game marketed under the trade mark "Equabble" which formed the subject matter of United Kingdom Patent Number 1396267. This game has a board divided into laterally and longitudinally arranged squares and a series of sets of tiles, one set bearing a numeral from 0 to 9, another set bearing mathematical operation symbols, i.e. + (addition), − (subtraction), × (multiplication) and ÷ (division), and a third set bearing the = (equals) symbol. In playing the game the tiles are arranged on the squares to form mathematical equations laterally or longitudinally from a known starting position. Scoring is obtained by adding the individual value provided at the corner of each tile. Scoring is also enhanced when equations are arranged on specifically marked squares which can double or triple the value of a tile or equation.

Another similar example is provided by United Kingdom patent number 1304882, wherein three similar sets of tiles are involved in playing the game. Scoring in this game is dependent on the number of tiles used to create equations as well as placement on specific squares on the board surface which provided bonus or premium points.

The present invention will seek to provide a mathematical game which is an improvement to the above mentioned mathematical games.

SUMMARY OF THE PRESENT INVENTION

In one form the invention resides in a mathematical game comprising a plurality of game pieces, each game piece adapted to be laterally or longitudinally located on a playing surface, wherein a first set of game pieces bears an identifying symbol and a second set of game pieces bears a mathematical operation symbol and an identifying symbol, whereby three game pieces comprising two games pieces selected from the first set and one game piece selected from the second set are arrangeable on the playing surface to form a mathematical equation such that the second set game piece is locatable between the first set game pieces wherein the second set game piece depicts the mathematical relationship between symbols of the first set game pieces.

The identifying symbol may be an alphabet character, a numeric character or a combination of both of such characters. Preferably on the second set game pieces the identifying symbol is located to the right side of the game piece and the mathematical operation symbol is located to the left side of the game piece.

It is preferable that the second set game pieces be provided with visual distinguishing characteristics. Ideally the second set game pieces are of a distinguishing colour in relation to the first set game pieces so that when the game pieces are arranged in mathematical equations on the playing surface the colour of the second set games pieces distinguishes one side of the mathematical equation from the other side of the equation effectively functioning as the mathematical equals (=) symbol thereby avoiding the need for separate game pieces bearing the equal (=) symbols to be included in the game.

In another form the invention resides in a mathematical game comprising a plurality of elongate tiles adapted to be laterally or longitudinally located on a playing surface, the elongate tiles comprising a set of numerical tiles bearing a numerical symbol and a set of operational tiles bearing a mathematical operation symbol and a numerical symbol, wherein on the operational tiles the numerical symbol is located to the right side of the tile and the mathematical operation symbol is located to the left side of the tile, whereby at least three tiles consisting of two numerical tiles and one operational tile are linearly arrangeable on the playing surface to form a mathematical equation such that the operational tile is locatable between the two numerical tiles wherein the operational tile reflects the mathematical relationship between the numerical tiles, the operational tiles being provided with a visual distinguishing characteristic so that when the tiles are arranged in an equation the operational tile distinguishes one side of the equation from the other.

It is preferable that the visual distinguishing characteristic is colour so that the operational tiles are of a different colour to the numerical tiles. The colour of the operational tile distinguishes one side of the equation from the other side thus the operational tile effectively functions as an equals (=) symbol.

The absence of a tile bearing the equals symbol from this game enables equations to be made in a relatively confined space on the playing surface and thus the game occupies less space.

In yet another form the invention resides in a method of playing a mathematical game by a first player and a second player comprising the steps of:

(a) providing a playing surface;

(b) providing a plurality of game pieces comprising a first set of game pieces bearing mathematical symbols and a second set of game pieces bearing a mathematical symbol and a mathematical operation symbol, wherein the second set game pieces are visually distinguishable from the first set game pieces;

(c) providing the first player and the second player each with a number of first set game pieces and a number of second set game pieces;

(d) the first player and the second player alternatively linearly arranging three game pieces comprising two first set game pieces and one second set game piece laterally or longitudinally on the playing surface whereby the second set game piece is located between the two first set game pieces to form a mathematical equation;

(e) the first player and the second player each drawing replacement game pieces from the plurality of game pieces;

(f) providing a score for the first player and the second player;

(g) repeating the steps of (c)-(f) until play ceases.

Preferably the first set game pieces comprise a numerical symbol. It is also preferable that the second set game pieces comprise a numerical symbol and a mathematical operation symbol. The score for each player is obtained by adding together the value of the numerical symbols provided on the numerical game pieces which form the equation made.

The invention will be better understood from the following description of a preferred embodiment.

DETAILED DESCRIPTION

Figure 1:
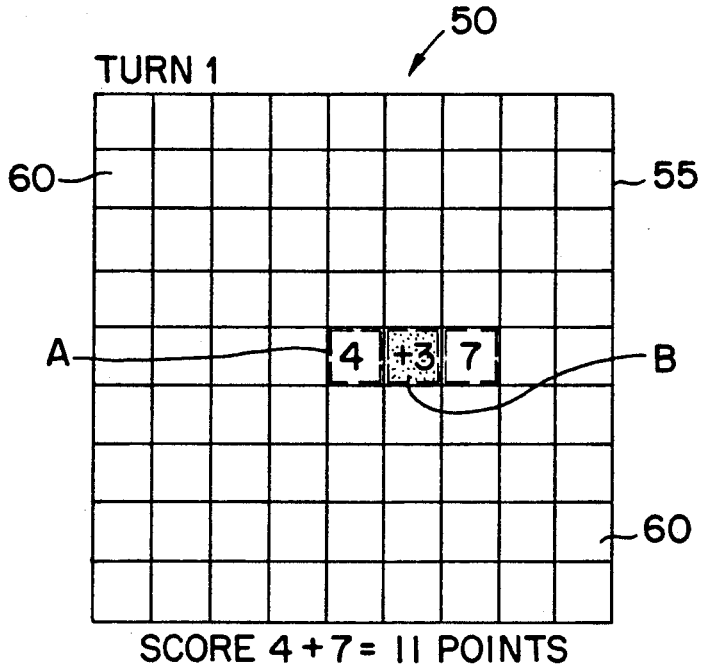
FIG. 1 is a plan view of three games pieces arranged to form a mathematical equation.

As seen in the drawings, the embodiment is directed to a mathematical game 50 comprising a playing surface 55 which is this embodiment in the form of a board bearing a rectangular grid defining a plurality of laterally and longitudinally arranged squares 60. In alternative arrangements, the game may be played on an unmarked playing surface such as a table, floor etc.

A plurality of game pieces in the form of square tiles are provided. Referring to FIGS. 1 to 4 there are two sets of tiles, one set of tiles wherein each tile bears a numerical symbol selected from 1 to 99, these tiles are termed numerical tiles indicated by the letter A. The other set of tiles has each tile bearing a numerical symbol selected from 1 to 99 as well as a mathematical operation symbol either × (multiplication), + (addition), − (subtraction), ÷ (division), these tiles are termed operational tiles designated by the letter B. The tiles A, B may be made of wood, cardboard, plastic or any other suitable material.

The operational tiles B are coloured differently from the numerical tiles A.

The purpose of the operational tile being of different colour to the numerical tiles is to avoid the need for an equals (=) symbol to be used in the making of equations. It has been found that the use of the equals symbol needlessly clutters up the playing surface, whereas to do away with the equals symbol makes the arrangement of the tiles on the playing surface more compact so that less space is required in playing the game and the playing game becomes relatively fast and hence lends itself to a more exciting game. The different coloured operational tile B distinguishes one side of the equation from the other thereby effectively functioning as an equals symbol so that the number to the immediate right or immediately below the operational tile is the answer to the equation. In addition the absence of the equals symbol facilitates more complex games to be played whereby more than one equation may be formed at one time.

In addition the operational tile B can also act as an educational aid to reflect the mathematical relationship between the numerical tiles A to the immediate left and immediate right of the operational tile B (in the case of equations made laterally), and the relationship between the numerical tiles A immediately above and immediately below the operational tile B (in the case of equations made longitudinally). In FIG. 1 the relationship between numerical tiles 4 and 7 is depicted by the intervening operational tile [+3] (the square box containing the mathematical operation symbol and the numeral is represented as the operational tile) and so the relationship between numerical tiles 4 and 7 is +3 (plus three).

To play the game two or more players are required. In the following give example of playing the game four players are participants. The tiles are firstly divided into two common piles of numerical tiles and operational tiles.

Firstly each player draws a numerical tile from the pile of numerical tiles and the player with either the highest or lowest number starts the game.

Each player then draws a total of eight tiles comprising five numerical tiles and three operational tiles.

Starting at any desired position on the playing surface 55 and utilising three tiles comprising two numerical tiles and one operational tile, the first player should assemble a mathematical equation. For example, FIG. 1 depicts the first player's turn wherein the equation 4 [+3] 7. To provide a score, the value of the two numerical tiles are added together. In this example the score is 11. i.e. (the sum of numerical tiles 4 and 7). Points are only awarded for the making of completed equations. The first player then draws three replacement tiles from the common piles.

After the initial equation is made further equations may be made with a maximum of three tiles using either:

(a) one numerical tile—to complete an incomplete equation already arranged on the playing surface, or (b) one operational tile—to be placed between two numerical tiles already on the playing surface, or (c) two numerical tiles—to be placed on each opposing side of an operational tile already present on the playing surface, or (d) one numerical tile and one operational tile—to be placed next to a numerical tile already on the playing surface, or (e) two numerical tiles and one operational tile—to create an equation whilst in some way completing an incomplete equation already on the playing surface.

Figure 2:
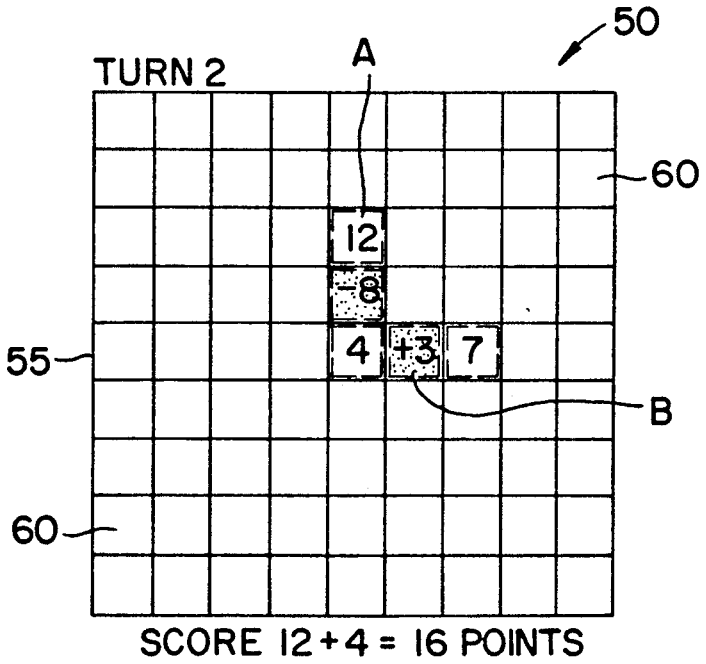
FIG. 2 is a plan view of a second mathematical equation added to that of FIG. 1.

FIG. 2 depicts as an example, the second player's turn wherein the numerical tile 12 and operational tile [−8] are arranged longitudinally above numerical tile 4 which formed part of the first equation made in order to form the equation of 12 [−8] 4. The score obtained in this example is 16, i.e. (the sum of numerical tiles 12 and 4). The second player then draws two replacement tiles from the common piles.

Figure 3:
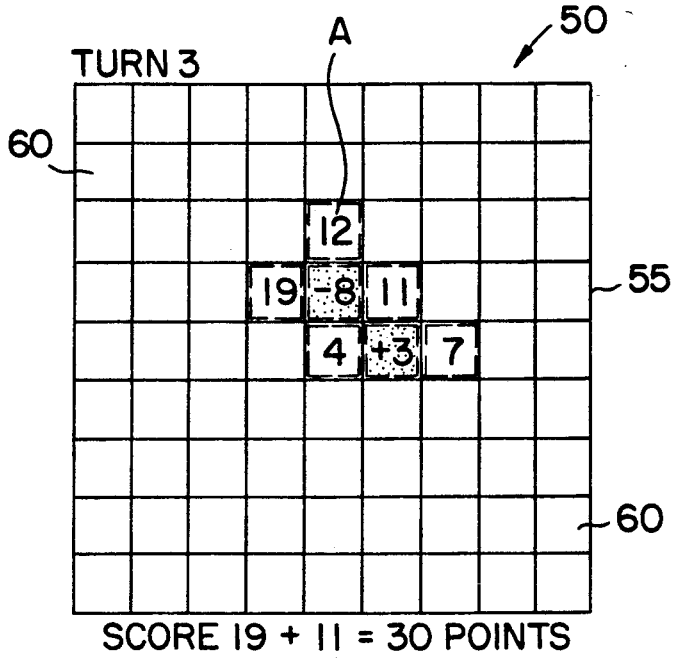
FIG. 3 is a plan view of a third mathematical equation added to that of FIG. 2.

FIG. 3 depicts as an example, the third player's turn wherein the two numerical tiles 19 and 11 are arranged laterally to each side of the operational tile [−8] which formed part of the second equation in order to form the equation 19 [−8] 11. The score obtained from this example is 30 i.e. (the combination of numerical tiles 19 and 11). The third player then draws two replacement tiles from the common piles.

Figure 4:
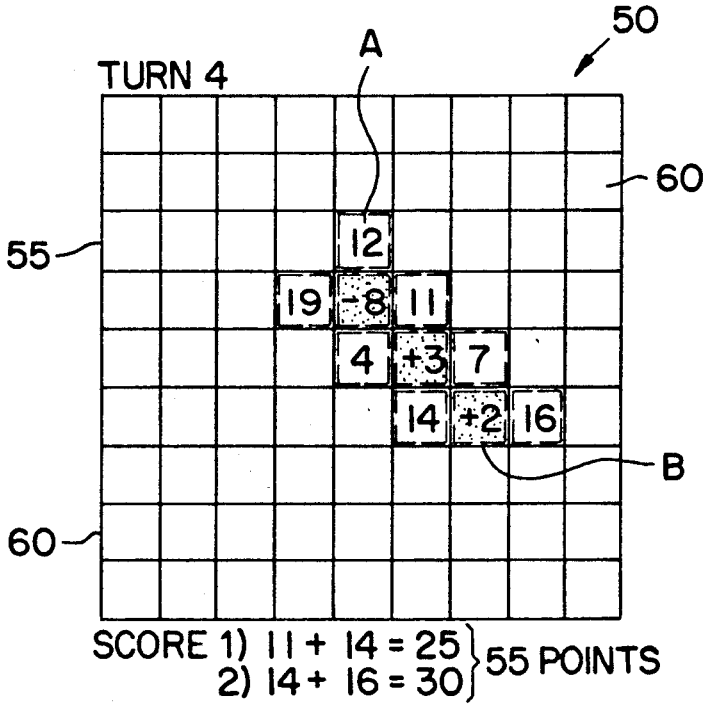
FIG. 4 is a plan view of a fourth mathematical equation added to that of FIG. 3.

FIG. 4 depicts as an example, the fourth player's turn wherein three tiles comprising two numerical tiles 14 and 16 and the operational tile [−2] are added to the longitudinally incomplete equation made up by the numerical tile 11 and the operational tile [−3]. The numerical tile 14 is arranged below the operational tile [−3] to form the equation 11 [−3] 14. The other two tiles consisting of the operational tile [−2] and numerical tile 16 are then arranged laterally next to the numerical tile 14 to form the equation 14 [+2] 16. So in this example by the arrangement of three tiles, two complete equations are formed. The score in this equation is 55 i.e. (the sum of numerical tiles in one equation 11, and 14, added to the sum of the numerical tiles in the second equation, 14 and 16). The fourth player then draws three replacement tiles from the common piles.

The above mentioned procedure is then repeated by each player until all the tiles are used up or until the players believe that it is no longer possible to make any more equations. If any player is unable to make an equation, then he or she forfeits his or her turn and it is the next player's turn to play. At the end of the game the player with the highest score wins the game.

The playing tiles A, B can also be used to play an alternative game which is more complex than the above described game. In this game each player is not restricted to a maximum of three tiles per turn. Instead any number of tiles from one to eight may be used to form one or more equations in sequence i.e. 4 [-3] 7 [-2] 14 provided that the tiles are arranged in one direction only and that each set of three tiles consisting of two numerical tiles and one operational tile form a completed equation. In the above mentioned example two completed equations 4 [-3] 7 and 7 [-2] 14 are created. Scoring for each turn is calculated in the same manner as in the first game described wherein only the value of the numerical tiles which form complete equations are added together. In the above example, the score would be the sum of numerical tiles 4 and 7 added to the sum of numerical tiles 7 and 14, so that a total score of 33 points is obtained. Each subsequent player can then add to the above equations either laterally or longitudinally.

In further embodiments marked areas on a playing board may be provided in order to allow bonus or premium points to be obtained.

One advantage provided by this invention is that it allows equations to be made occupying less space on the playing surface thus allowing more complex games to be played within a relatively confined space. Another advantage is that only two sets of game pieces are needed to play the game wherein one set of game pieces carries numerical symbols and the other set of game pieces carries both a numerical symbol and a mathematical operational symbol without the need for tiles bearing the equals symbol.

I claim:

1. A mathematical game comprising a plurality of game pieces, each game piece adapted to be laterally or longitudinally located on a playing surface, wherein a first set of game pieces bears an identifying symbol and a second set of game pieces bears a mathematical operation symbol and an identifying symbol, whereby three game pieces comprising two games pieces selected from the first set and one game piece selected from the second set are arrangeable on the playing surface to form a mathematical equation such that the second set game piece is locatable between the first set game pieces wherein the second set game piece depicts the mathematical relationship between identifying symbols of the first set game pieces.

2. A mathematical game as claimed in claim 1 wherein the identifying symbol may be an alphabet character or a numerical character or a combination of both such characters.

3. A mathematical game as claimed in claim 1 wherein on the second set game pieces the identifying symbol is located to the right side of the game piece and the mathematical operation symbol is located to the left side of the game piece.

4. A mathematical game as claimed in claim 1 wherein the second set game pieces is provided with a visual distinguishing characteristic.

5. A mathematical game as claimed in claim 1 wherein the second set game pieces are of a distinguishing colour in relation to the first set game pieces so that when the game pieces are arranged in a mathematical equation on the playing surface the colour of the second set games piece distinguishes the one side of the mathematical equation from the other side of the equation.

6. A mathematical game comprising a plurality of elongate tiles adapted to be laterally or longitudinally located on a playing surface, the elongate tiles comprising a set of numerical tiles bearing a numerical symbol and a set of operational tiles bearing a mathematical operation symbol and a numerical symbol, wherein on the operational tiles the numerical symbol is located to the right side of the tile and the mathematical operation symbol is located to the left side of the tile, whereby three tiles consisting of two numerical tiles and one operational tile are linearly arrangeable on the playing surface to form a mathematical equation such that the operational tile is locatable between the two numerical tiles wherein the operational tile reflects the mathematical relationship between the numerical tiles, the operational tiles being provided with a visual distinguishing characteristic so that when the tiles are arranged in an equation the operational tile distinguishes one side of the equation from the other.

7. A mathematical game as claimed in claim 6 wherein the visual distinguishing characteristic is colour whereby the colour of the operational tile distinguishes one side of the equation from the other side.

8. A method of playing a mathematical game by a first player and a second player comprising the steps of:

(a) providing a playing surface;

(b) providing a plurality of game pieces comprising a first set of game pieces bearing mathematical symbols and a second set of game pieces bearing a mathematical symbol and a mathematical operation symbol, wherein the second set game pieces are visually distinguishable from the first set game pieces;

(c) providing the first player and the second player each with a number of first set game pieces and a number of second set game pieces;

(d) the first player and the second player alternatively linearly arranging three game pieces comprising two first set game pieces and one second set game piece laterally or longitudinally on the playing surface whereby the second set game piece is located between the two first set game pieces to form a mathematical equation;

(e) the first player and the second player each drawing replacement game pieces from the plurality of game pieces;

(f) providing a score for the first player and the second player;

(g) repeating the steps of (c)–(f) until play ceases.

9. A method of playing a mathematical game as claimed in claim 8 wherein the first set game pieces comprise a numerical symbol and the second set game pieces comprise a numerical symbol and a mathematical operation symbol.

10. A method of playing a mathematical game as claimed in claim 8 wherein the score for each player is obtained by the addition of the value of the numerical symbols provided on the first set game pieces which form the mathematical equation.

* * * * *